US011575205B2

(12) United States Patent
Ouchi

(10) Patent No.: US 11,575,205 B2
(45) Date of Patent: Feb. 7, 2023

(54) ELECTROMAGNETIC WAVE TRANSMISSION/RECEPTION DEVICE

(71) Applicant: Kazuyuki Ouchi, Hyogo (JP)

(72) Inventor: Kazuyuki Ouchi, Hyogo (JP)

( * ) Notice: Subject to any disclaimer, the term of this patent is extended or adjusted under 35 U.S.C. 154(b) by 0 days.

(21) Appl. No.: 17/326,665

(22) Filed: May 21, 2021

(65) Prior Publication Data

US 2021/0376472 A1 Dec. 2, 2021

(30) Foreign Application Priority Data

May 29, 2020 (JP) ..... JP2020-093834

(51) Int. Cl.
*H01Q 9/04* (2006.01)
*H01Q 19/10* (2006.01)

(52) U.S. Cl.
CPC ..... *H01Q 9/04* (2013.01); *H01Q 19/10* (2013.01)

(58) Field of Classification Search
CPC ..... H01Q 1/00; H01Q 9/04; H01Q 9/0485; H01Q 11/04; H01Q 19/10; H01Q 19/28
See application file for complete search history.

(56) References Cited

U.S. PATENT DOCUMENTS

2010/0259343 A1* 10/2010 Toujo ..... H01P 1/20 333/219
2011/0221547 A1* 9/2011 Tezuka ..... G06K 7/10316 333/236
2017/0155180 A1* 6/2017 Ouchi ..... H01P 3/16

FOREIGN PATENT DOCUMENTS

JP 2017-108394 A 6/2017

* cited by examiner

*Primary Examiner* — Thai Pham
(74) *Attorney, Agent, or Firm* — IP Business Solutions, LLC

(57) ABSTRACT

When three directions perpendicular to each other are defined as x-direction, y-direction and z-direction, the electromagnetic wave reception device is provided with the two or more antenna electrodes extending in the x-direction, the two or more antenna electrodes are arranged parallel to each other and arranged in the z-direction, and the two or more antenna electrodes are connected by the common lead wire, and the antenna electrodes are connected between the two or more antenna electrodes that are adjacent to each other by repeatedly applying a voltage having opposite characteristics to each other, an electromagnetic wave having a resonance frequency determined by the electromagnetic wave velocity and a distance between the antenna electrodes that are adjacent to each other is induced, and the electromagnetic wave is transmitted to a space in the z-direction.

10 Claims, 9 Drawing Sheets

ELECTROMAGNETIC WAVE TRANSMISSION/RECEPTION DEVICE

BACKGROUND OF THE INVENTION

Fields of Invention

The present Invention relates to an electromagnetic wave transmission/reception device, specifically to relates the electromagnetic wave transmission/reception device in which by applying the alternating voltage between two electrodes to generate an electric field, the electromagnetic wave is generated and transmitted to an external space, and the electromagnetic wave propagating in the external space is received for extracting a signal.

Description of Related Art

Waveguide technology and transmission/reception technology are important elements in fields such as satellite communication and information communication using microwaves and millimeter waves.

For example, there is proposed a waveguide device in which an input electrode or an output electrode is provided in a waveguide, an electromagnetic wave is input to the waveguide to guide the electromagnetic wave, or an electric signal is output from an electromagnetic wave propagating in the waveguide, two or more electrodes having a shape extending in the width direction of the waveguide are arranged in the direction of electromagnetic wave traveling, and a high frequency current is applied between the adjacent electrodes of the two or more input electrodes, and by arranging the outer peripheral shape of the electrode arrangement in the waveguide in a shape corresponding to a part or all of the shape specified by Equation 1, the electronic signal from the outside can be accurately and efficiently input to the waveguide with less noise, as a result the electronic signal having a desired frequency is output accurately, efficiently, and with less noise from an electromagnetic wave that has been input or propagated through the waveguide (Patent Document 1).

$$\tan(k_s\, a/2)=k_f/k_s \text{ or } \tan(k_s\, a/2)=-k_s/k_f \qquad \text{Formula 1:}$$

The former equation is the equation when the electromagnetic wave is propagated by the cosine (cos), and the latter equation is the equation when the electromagnetic wave is propagated by the sine (sin). $K_s$: Propagation constant in the low velocity region of electromagnetic waves, $K_f$: Propagation constant in the high velocity region of electromagnetic waves, a: Maximum dimension in the width direction X and/or the height direction Y of the waveguide.

Patent Document 1: JP-A-2017-108394

DISCLOSURE OF THE INVENTION

Technical Problem

However, the waveguide technology of Patent Document 1 is a technique for inputting an electromagnetic wave into the dielectric waveguide to guide it and outputting a signal of the electromagnetic wave propagating through the waveguide, and the electromagnetic wave is transmitted in the width direction of the waveguide. That is, the waveguide technology of Patent Document 1 is proposed to be confined in direction x, and it was not known what the voltage applied between the electrodes would be if there was no waveguide.

Further, the technique of Patent Document 1 is an effective technique for confining and to waveguide the electromagnetic waves in the width direction of the waveguide to extract an electronic signal, but it was not known how to design to transmission of electromagnetic waves and reception of electromagnetic waves from the outside when there is no waveguide.

It is an object of the present Invention to provide an electromagnetic wave transmission/reception device capable of transmitting and receiving the electromagnetic waves when there is no waveguide.

Solution of Problem

Therefore, when the three directions perpendicular to each other are defined as the x-direction, the y-direction and the z-direction, the electromagnetic wave transmission device according to the present Invention is provided two or more electrodes extending in the x-direction, the electrodes are arranged in parallel with each other and arranged in the z-direction, the above two or more electrodes are connected by a common lead wire for each of the above two or more electrodes, by repeatedly applying voltages having opposite characteristics to each other between the electrodes adjacent to each other among the above electrodes, the electromagnetic wave having a resonance frequency determined by the electromagnetic wave velocity and the distance between the electrodes is induced between the adjacent electrodes.

Further, when the three directions perpendicular to each other are defined as the x-direction, the y-direction and the z-direction, the electromagnetic wave reception device according to the present Invention is provided two or more electrodes extending in the x-direction, the electrodes are arranged in parallel with each other and arranged in the z-direction, the two or more electrodes are connected one by one by a common lead wire for each of the above two or more electrodes, the electromagnetic wave transmitted in the z-direction in space is received by the two or more electrodes, an electric charge is induced between adjacent electrodes by an electromagnetic wave having a resonance frequency in which the electric charge is characterized in that determined by the electromagnetic wave velocity and the distance between the electrodes, and a voltage is the generate, the voltage is output as an alternating current from the lead wire.

The present Inventor conducted diligent research on the emission of electromagnetic waves and the incident of electromagnetic waves from the outside in a situation where there is no mode in the width direction of the waveguide in the dielectric waveguide, when the electrodes are arranged in the traveling direction z and repeatedly applying a voltage of opposite characteristics to each other, an electric field mode in the electromagnetic wave traveling direction z regardless of the width direction x, and an electric field vibration is induced, the electromagnetic wave is generated, as a result the conclusion that the electromagnetic waves can be emitted into the space outside has come to.

The present Invention has been made based on such knowledge, and the first feature according to the present Invention is to provide an electromagnetic wave transmission/reception device capable of transmitting or receiving the electromagnetic waves accurately and efficiently with a simple configuration.

The second feature of the present Invention is that the electromagnetic waves are efficiently and linearly radiated because the characteristics of the electromagnetic waves in the width direction of the waveguide does not be utilized, there is no distribution of the electromagnetic waves in the width direction, and the electromagnetic wave is emitted from an electromagnetic wave generator composed of electrodes has good straightness so that it can be transmitted or received.

[Transmission Principle]

The transmission principle of the electromagnetic wave transmission device according to the present Invention is as follows. When the three directions perpendicular to each other are the x-direction, the y-direction and the z-direction, two or more antenna electrodes extending in the x-direction are arranged parallel to each other and arranged in the z-direction, and a voltage is applied between the adjacent antenna electrodes, a large displacement current flows between the antenna electrodes at the frequency (resonance frequency) determined by the electromagnetic wave velocity and the distance between the electrodes, and a magnetic field is generated around this displacement current. When voltage is repeatedly applied, that is, when an alternating voltage is applied, the opposite characteristics electromagnetic waves are formed for the entire period in accordance with alternating current, a mode is generated, and the electromagnetic wave mode is emitted to the external space without stopping.

[Reception Principle]

The reception principle in the electromagnetic wave reception device according to the present Invention is as follows. When a half-wavelength electromagnetic wave corresponding to the distance between antenna electrodes are present in space, an electric charge is induced between the opposing antenna electrodes by an electric field existing between the antenna electrodes to generate a voltage. When the three directions perpendicular to each other are the x-direction, the y-direction, and the z-direction, and the antenna electrodes are configured as two or more electrodes extending in the x-direction are arranged parallel to each other and in the z-direction, the antenna electrodes configuration has the resonance characteristic, that is, a resonance frequency determined by the electromagnetic wave velocity and the distance between the electrodes, the conductance is maximized at the resonance frequency, the maximum current flows due to the charge induced between the electrodes, and the reverse voltage is induced every half cycle to detect it as an alternating current.

FIG. 4 shows an example of the relationship between the resonance frequency of 10 GHz and conductance when the electrode space is 1.5 cm.

The electromagnetic wave transmission device according to the present Invention can adopt, for example, the configuration shown in FIG. 1. When the three directions perpendicular to each other are the x-direction, the y-direction, and the z-direction, two or more electrodes 11 and 12 extending in the x-direction are arranged side by side in the z-direction and parallel to each other. The plurality of electrodes 11 and 12 are connected by common lead wires 13 and 14 at the center of the width direction x of the electrodes 11 and 12, and lead wires are connected between the electrodes 11 and 12 adjacent to each other among the two or more electrodes. A voltage having opposite characteristics is repeatedly applied to each other by common lead wires 13 and 14.

The electromagnetic wave reception device can adopt the same configuration as shown in FIG. 1

In the above example, the plurality of electrodes 11 and 12 are connected one by one by common lead wires 13 and 14 at the center of the electrodes 11 and 12 in the width direction x, but as shown in FIG. 2, the electrodes 11 and 12 are connected. It is also possible to provide the common lead wires 13 and 14 at the end portions of the electrodes 11 and 12 in the width direction, and to connect the plurality of electrodes 11 and 12 one by one by the common lead wires 13 and 14.

Further, although the lengths of the electrodes 11 and 12 in the width direction x are the same lengths as shown in FIG. 2, the lengths of the electrodes 11 and 12 in the width direction x can be different lengths as shown in FIG. 3

Further, in the above examples, all the electrodes 11 and 12 are connected to the lead wires 13 and 14 for supplying the power for generating electromagnetic waves, but the metal rod 15, for example metal rod in a shape of the electrode to which the lead wires are not connected may be provided, and the electromagnetic wave reflection characteristics of the metal rod 15 may be provided. It can be expected that the electromagnetic wave transmission performance will be improved when an electrode is installed for the purpose of resonating with the generation of electromagnetic waves.

As shown in FIG. 5 and FIG. 6, the metal rod 15 can be installed on one side or both sides of the electrodes 11 and 12 to which the lead wires 13 and 14 are connected in the z-direction or not connected in the z-direction.

Further, the metal rods 15 can be connected each other or can't be connected each other for providing the performance of resonating electromagnetic waves.

A reception device having the above configuration is also possible.

As shown in FIG. 7, the transmission performance can be improved by providing the reflector 16 in one of the z-direction of the electrodes 11 and 12 connected to the lead wires 13 and 14. Further, as shown in FIG. 8, the reflector 16 may be provided on one side of the electrodes 11 and 12 connected to the lead wires 13 and 14 in the z-direction, and the metal rod 15 for resonance may be provided on the other side. Further, as shown in FIG. 9, the metal rods 15 intended for resonance are provided in both side of the z-directions of the electrodes 11 and 12 connected to the lead wires 13 and 14, and the reflector 16 is provided in one of the z-direction.

The reception device having the above configuration is also possible.

DETAILED DESCRIPTION OF THE PREFERRED EMBODIMENTS

Example 1

Figure 1:
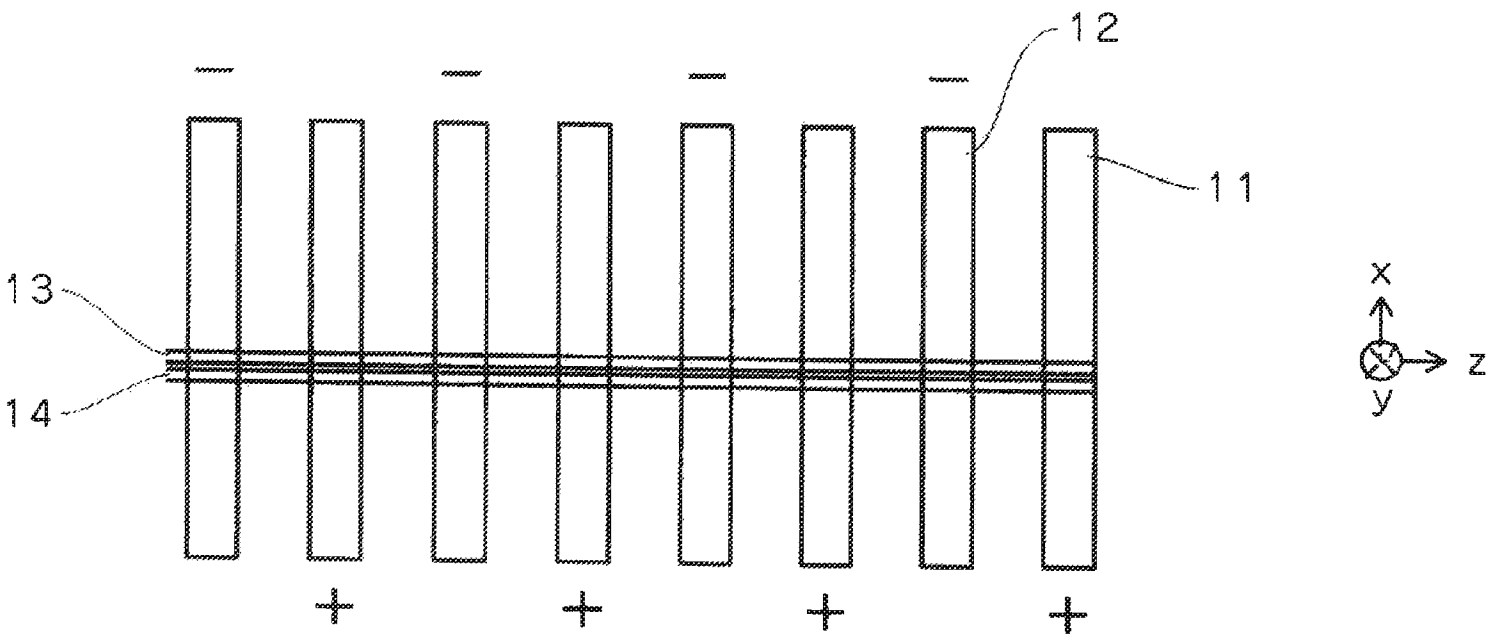
FIG. 1 is a diagram showing an example of the configuration of the electromagnetic wave transmission/reception device according to the present Invention.
Figure 2:
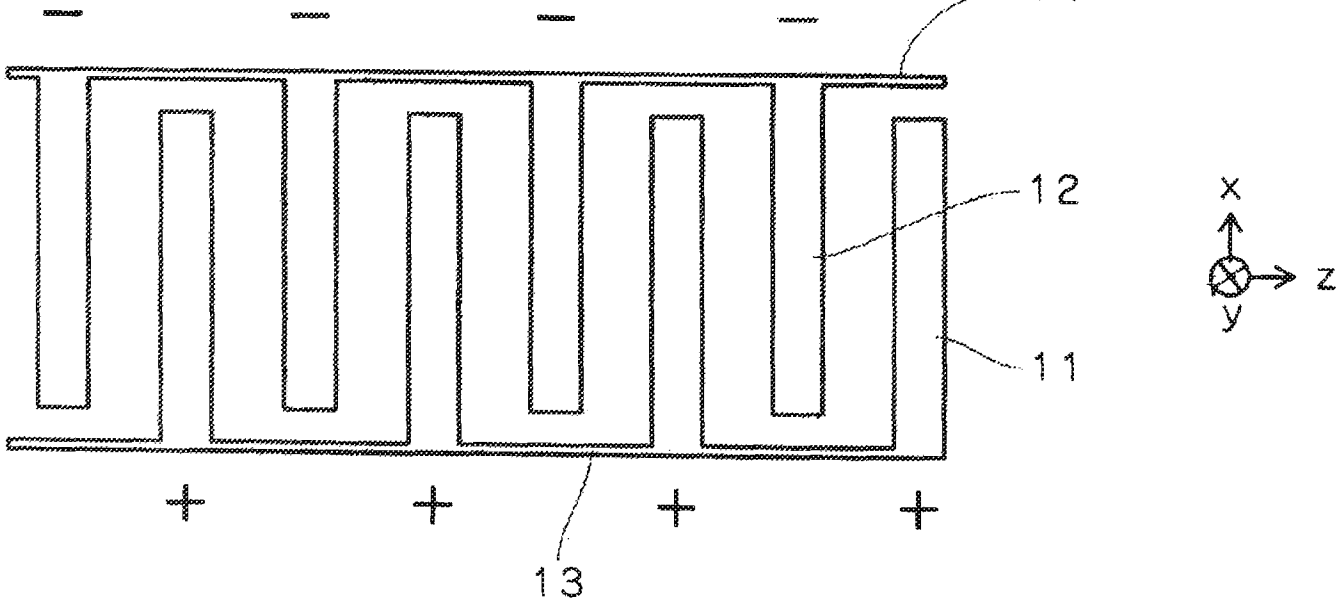
FIG. 2 is a diagram showing another example of the configuration of the electromagnetic wave transmission/reception device according to the present Invention.
Figure 3:
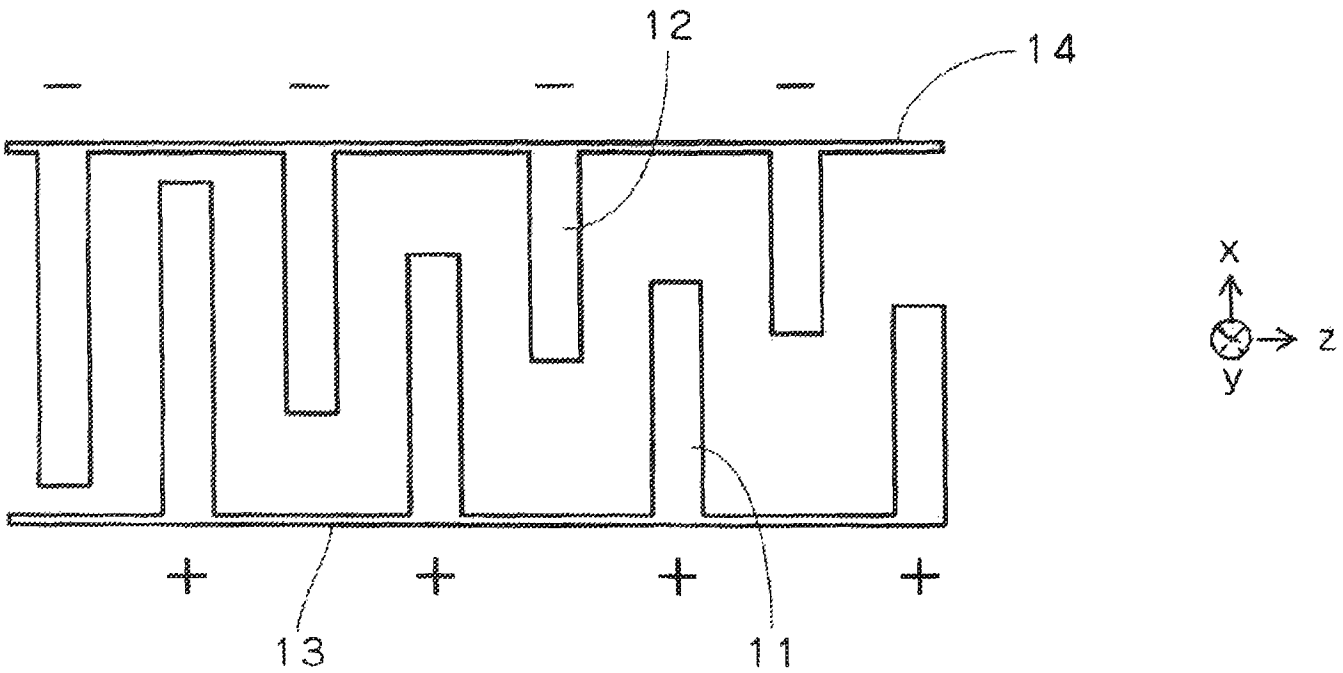
FIG. 3 is a diagram showing still another example of the configuration of the electromagnetic wave transmission/reception device according to the present Invention.
Figure 4:
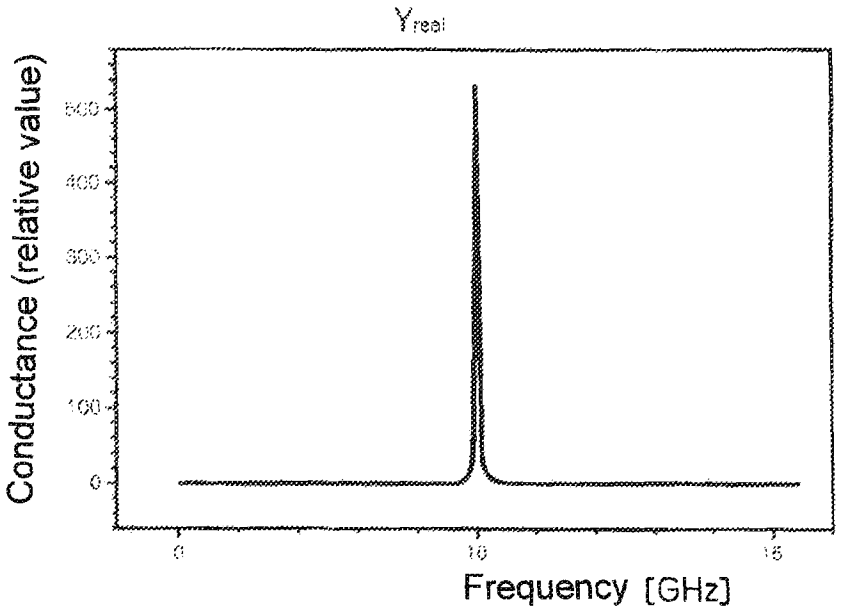
FIG. 4 is a diagram showing the relationship between the resonance frequency and conductance in the first embodiment.
Figure 5:
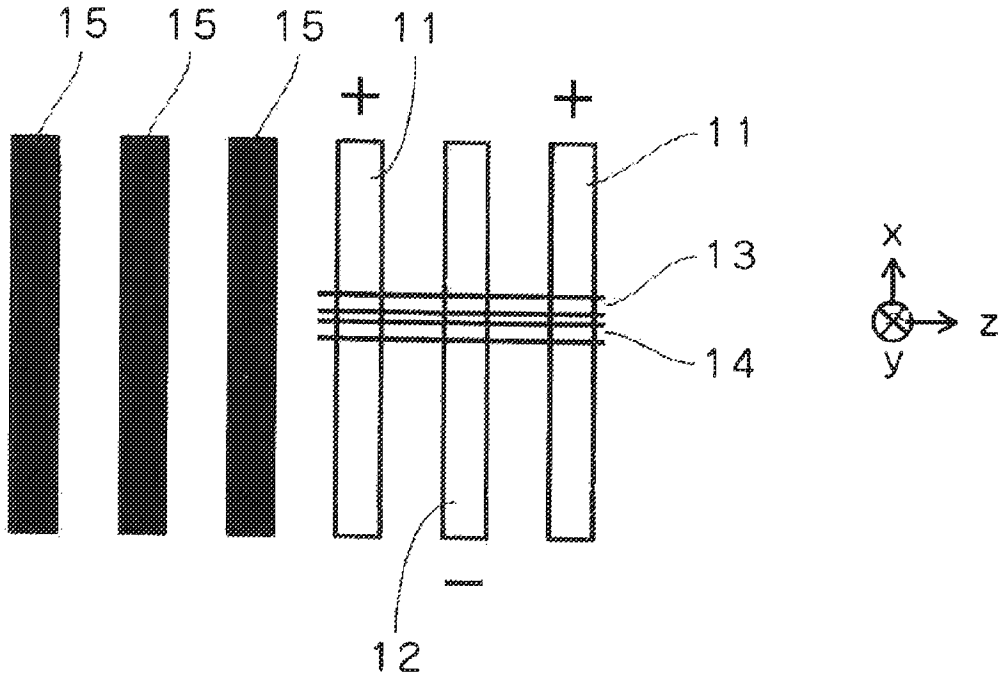
FIG. 5 is a diagram showing further example of the configuration of the electromagnetic wave transmission/reception device according to the present Invention.
Figure 6:
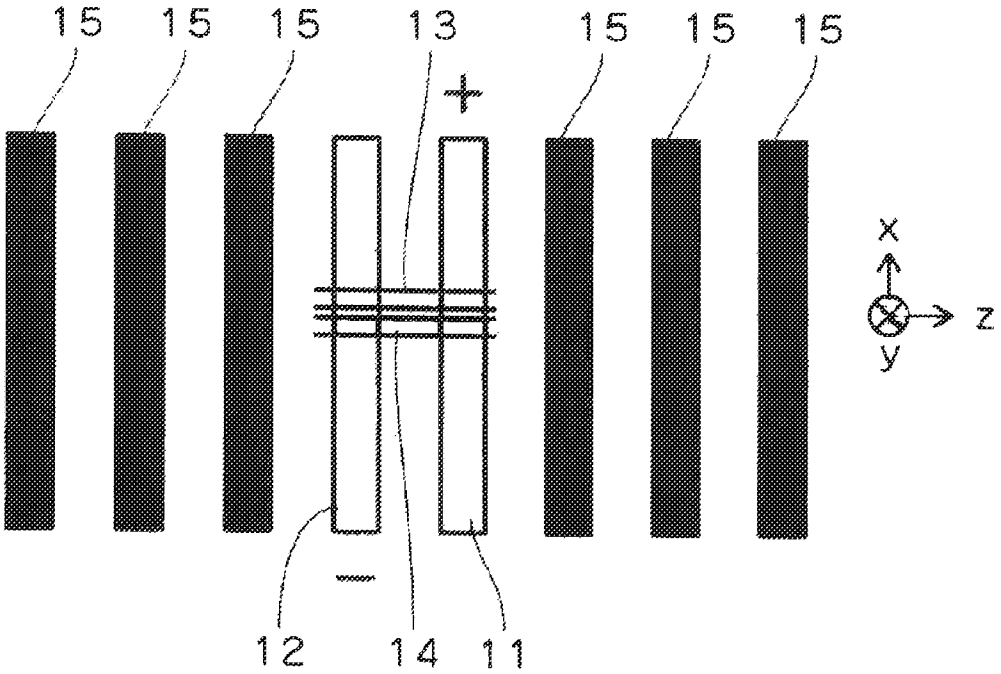
FIG. 6 is a diagram showing another example of the configuration of the electromagnetic wave transmission/reception device according to the present Invention.
Figure 7:
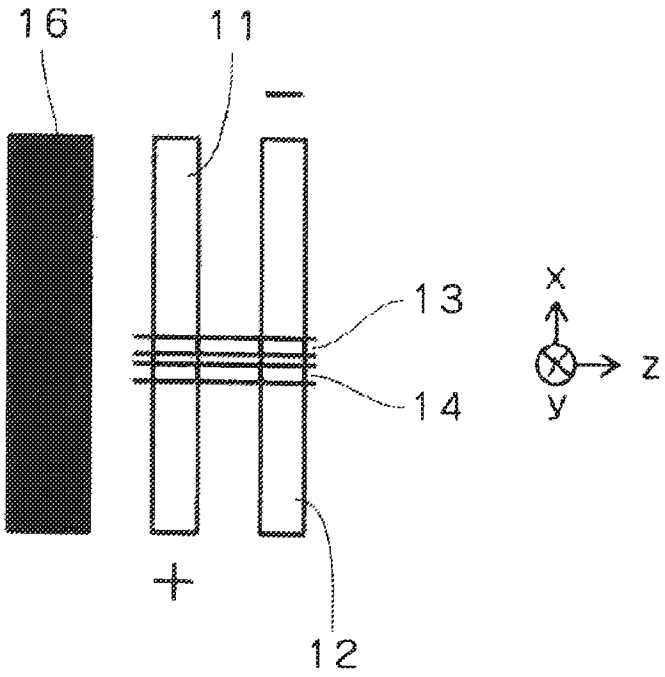
FIG. 7 is a diagram showing further example of the configuration of the electromagnetic wave transmission/reception device according to the present Invention.
Figure 8:
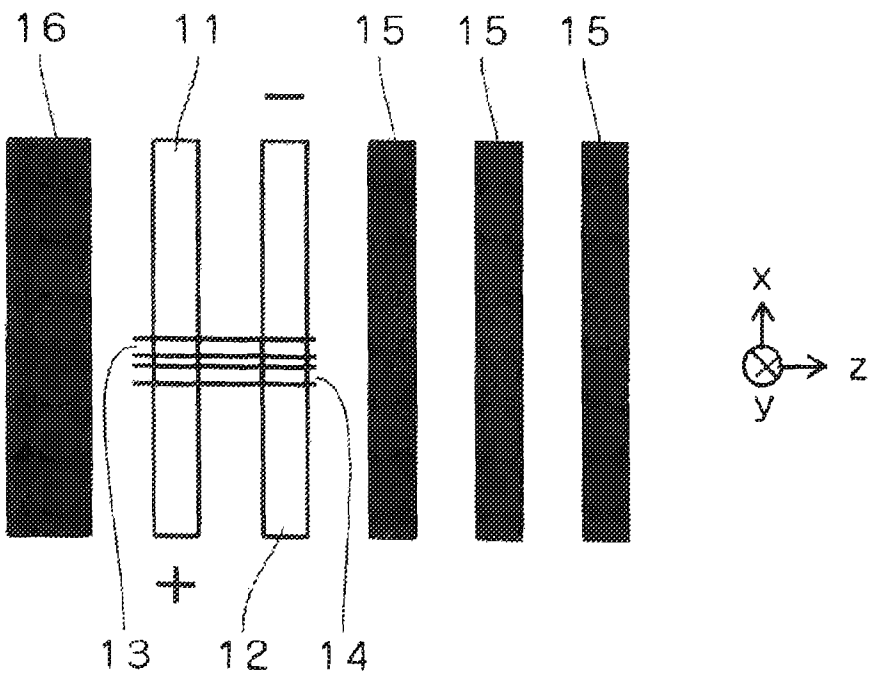
FIG. 8 is a diagram showing or another example of the configuration of the electromagnetic wave transmission/reception device according to the present Invention.
Figure 9:
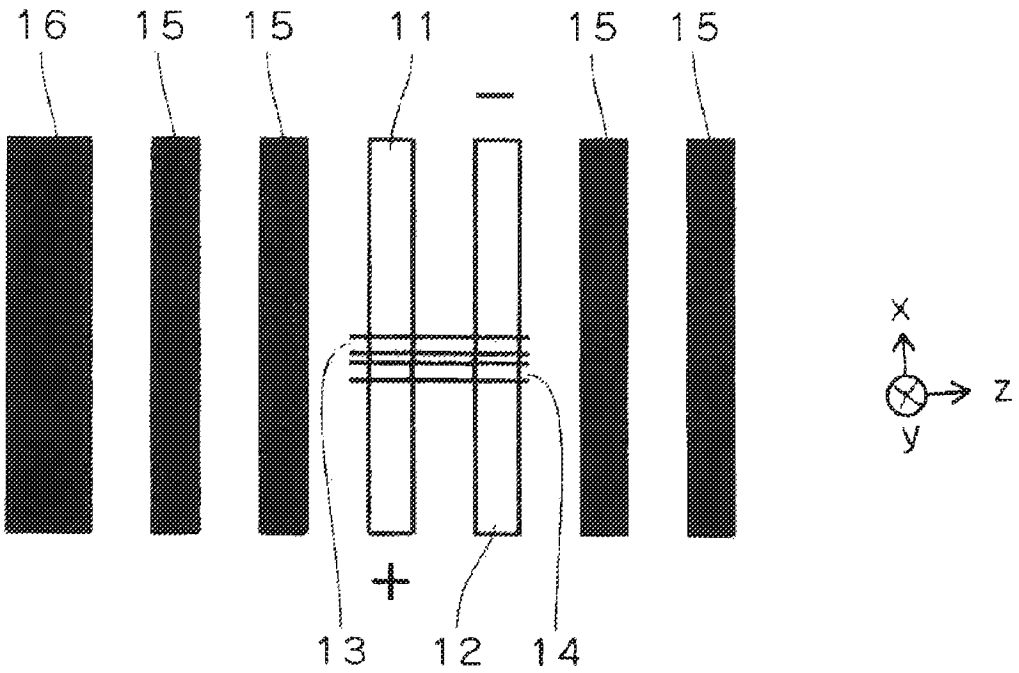
FIG. 9 is a diagram showing still another example of the configuration of the electromagnetic wave transmission/reception device according to the present Invention.

When transmitting or receiving electromagnetic waves with a frequency of 10 GHz, the electrode space is 1.5 cm, the width x is 15 cm, the electrode material is copper, the electrode cross-sectional shape is circular, the overall shape is columnar, the electrodes dimension was diameter 5 mm and the total length of the electrodes in the electromagnetic wave transmission direction z was 11.0 cm.

Example 2

When transmitting or receiving electromagnetic waves with a frequency of 10 THz, the electrode space is 15 μm and the width x is 150 μm. The electrode material is copper, the cross-sectional shape of the electrode is circular, and the overall shape is columnar. The electrode dimensions were 5 μm in diameter and 110.0 μm in total length of the electrode in the electromagnetic wave transmission direction z.

Example 3

When transmitting or receiving electromagnetic waves with a frequency of 100 MHz, the electrode space is 1.5 m, the width x is 15 m, the electrode material is copper, the electrode cross-sectional shape is circular, the overall shape is columnar, and the electrode dimensions are diameter. The total length of the electrodes was 10 mm and the electromagnetic wave transmission direction z was 10.51 m.

DESCRIPTION OF REFERENCE NUMERALS

11, 12 Electrodes
13, 14 Lead wires
15 Electrodes for resonance
16 Reflector

What is claimed is:

1. An electromagnetic wave transmission device for emitting electromagnetic waves into a space outside, the electromagnetic wave transmission device comprising:
two or more antenna electrodes; and
a common lead wire,
wherein when three directions perpendicular to each other are designated as a x-direction, a y-direction and a z-direction, the two or more antenna electrodes extending in the x-direction are arranged parallel to each other in the z-direction, and the two or more antenna electrodes are alternately connected by the common lead wire, and the antenna electrodes are adjacent to each other by repeatedly applying a voltage having opposite characteristics to each other, at least one of the electromagnetic waves having a resonance frequency determined by an electromagnetic wave velocity and a distance between the antenna electrodes is induced, and the at least one of the electromagnetic waves is transmitted to the space outside in the z-direction.

2. The electromagnetic wave transmission device according to claim 1, wherein a distance between the two or more antenna electrodes is equal and is set to ½ a length of a wavelength determined by the electromagnetic wave velocity and the resonance frequency of the applied alternating voltage.

3. The electromagnetic wave transmission device according to claim 1, wherein the two or more antenna electrodes have portions having different lengths in the x-direction.

4. The electromagnetic wave transmission device according to claim 1, wherein a resonance metal rod that does not supply electric power with the common lead wire is installed on one side or both sides of the antenna electrode in the z-direction.

5. The electromagnetic wave reception device according to claim 1, wherein a resonance metal rod that does not supply electric power by the common lead wire is installed on one side or both sides of the antenna electrode in the z direction.

6. The electromagnetic wave transmission device according to claim 1, wherein a reflector is installed on one side of the antenna electrode in the z-direction.

7. An electromagnetic wave reception device for receiving electromagnetic waves transmitted in a space outside, the electromagnetic wave reception device comprising:
two or more antenna electrodes; and
a common lead wire,
wherein when three directions perpendicular to each other are defined as a x-direction, a y-direction, and a z-direction, two or more antenna electrodes extending in the x direction are arranged parallel to each other in the z direction, and the two or more antenna electrodes are connected by the common lead wire and at least one of the electromagnetic waves transmitted in the z direction in the space outside are received by the two or more antenna electrodes, and adjacent antenna electrodes are generated by the at least one of the electromagnetic waves with a resonance frequency that is determined by an electromagnetic wave velocity and a distance between the antenna electrodes and a voltage is induced between the two antenna electrodes and an AC current from the lead wire is output.

8. The electromagnetic wave reception device according to claim 7, wherein the distance between the two or more antenna electrodes is equal each other and is set to ½ a length of a wavelength determined by the electromagnetic wave velocity and the resonance frequency of the applied alternating voltage.

9. The electromagnetic wave reception device according to claim 7, wherein the two or more antenna electrodes have portions having different lengths in the x-direction.

10. The electromagnetic wave reception device according to claim 7, wherein a reflector is installed on one side of the antenna electrode in the z direction.

* * * * *